US007942400B2

(12) United States Patent
DeMarco

(10) Patent No.: US 7,942,400 B2
(45) Date of Patent: May 17, 2011

(54) SADDLE STITCHER WITH ALIGNMENT PADDLE

(76) Inventor: Burton Harold DeMarco, East Berlin, PA (US)

( * ) Notice: Subject to any disclaimer, the term of this patent is extended or adjusted under 35 U.S.C. 154(b) by 43 days.

(21) Appl. No.: 12/456,154

(22) Filed: Jun. 12, 2009

(65) Prior Publication Data

US 2010/0314819 A1 Dec. 16, 2010

(51) Int. Cl.
*B42B 2/00* (2006.01)

(52) U.S. Cl. ..... 270/58.29; 270/52.18; 270/58.26

(58) Field of Classification Search ..... 270/52.18, 270/52.29, 58.26, 58.27, 58.23; 271/233
See application file for complete search history.

(56) References Cited

U.S. PATENT DOCUMENTS

| | | | | |
|---|---|---|---|---|
| 1,253,247 | A * | 1/1918 | Jennings, Jr. | 270/58.26 |
| 3,362,304 | A * | 1/1968 | Skoinick | 198/419.2 |
| 3,979,115 | A * | 9/1976 | Bruckner et al. | 271/261 |
| 4,266,761 | A * | 5/1981 | Buck | 270/58.01 |
| 4,548,393 | A * | 10/1985 | Irvine et al. | 270/59 |
| 5,829,953 | A * | 11/1998 | Fehringer et al. | 414/789.1 |
| 5,876,029 | A * | 3/1999 | Wright et al. | 271/3.18 |
| 6,517,064 | B2 * | 2/2003 | Glanzmann | 270/52.28 |

* cited by examiner

*Primary Examiner* — Patrick Mackey

(57) ABSTRACT

An improved saddle stitcher incorporating alignment paddle which includes paddle 100, a base 200, and torque producing means wherein the torque producing means rotates the paddle which contacts and jogs passing signature groups, thereby aligning them.

4 Claims, 11 Drawing Sheets

SADDLE STITCHER WITH ALIGNMENT PADDLE

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

1. Field of Invention

This invention generally relates to an improved saddle stitcher, specifically the incorporation of a signature alignment paddle into the stitcher design.

2. Prior Art

In the past ten years, printing design has become much more complicated, with intricate page designs which sometimes include continuous images which cross over from one page to the next. Designs of this type require that the individual sheets (signatures) jog up or head up, meaning that the top of all sheets are precisely aligned.

For the past 30 years, a number of methods have been employed during the printing process for signature alignment. The standard method currently used to align the signatures is with the use of a piece of spring steel attached to the stitcher. The spring steel is oriented so that it hangs down just above the signatures. It is typically bent by hand so that it lightly drags across the signatures. The intent is that this dragging action will pull the signatures against a stop and thereby align them. This method has a number of shortcomings however. Sometimes a signature rides too high on the saddle and the spring steel drags the signature off the conveyor chain, or creates a jam-up on the chain. Sometimes the spring steel pressure is too high and the steel scratches the signature. Other times the pressure is too low and the device fails to move the signature against the stop.

Another method currently used for signature alignment is the use of one or more strings mounted to the saddle stitcher. The strings are positioned in such a way as to drag along the outside of the signature as it passes. This dragging is intended to draw the signature back to a stop, where presumably it would align with a signature underneath. This method also has a number of drawbacks. First, excess drag by the string will dislodge the signature and will disrupt production. This is especially common when the signatures are textured or otherwise coated with a substance which tends to stick to the string. In addition, this method is only effective at dragging the top signature. It is not uncommon in production runs however, to have as many as six or more signatures gathered. In these cases, the string would typically only pull the top layer to the stop.

A third method is to simply place an individual along side the production line and have them manually jog each signature group to achieve the desired alignment. This method has a number of shortcomings however. First, it requires the employment of one or more individuals and adds to the cost of production. Second, manual jogging requires that the production rate be slowed to accommodate the reflexes of the average person.

OBJECTS AND ADVANTAGES

The object of the present invention is to provide an improved saddle stitcher which will precisely align multiple signatures simultaneously, which is not sensitive to surface texture of the signatures, will accommodate any production rate, and does not require manual action.

BRIEF SUMMARY OF THE INVENTION

The present invention incorporates a stitcher paddle into the saddle stitcher. The stitcher paddle is mounted on a pivot and is rotated into the signature group as it passes, jogging and aligning the individual signatures.

DETAILED DESCRIPTION OF THE INVENTION

Figure 1:
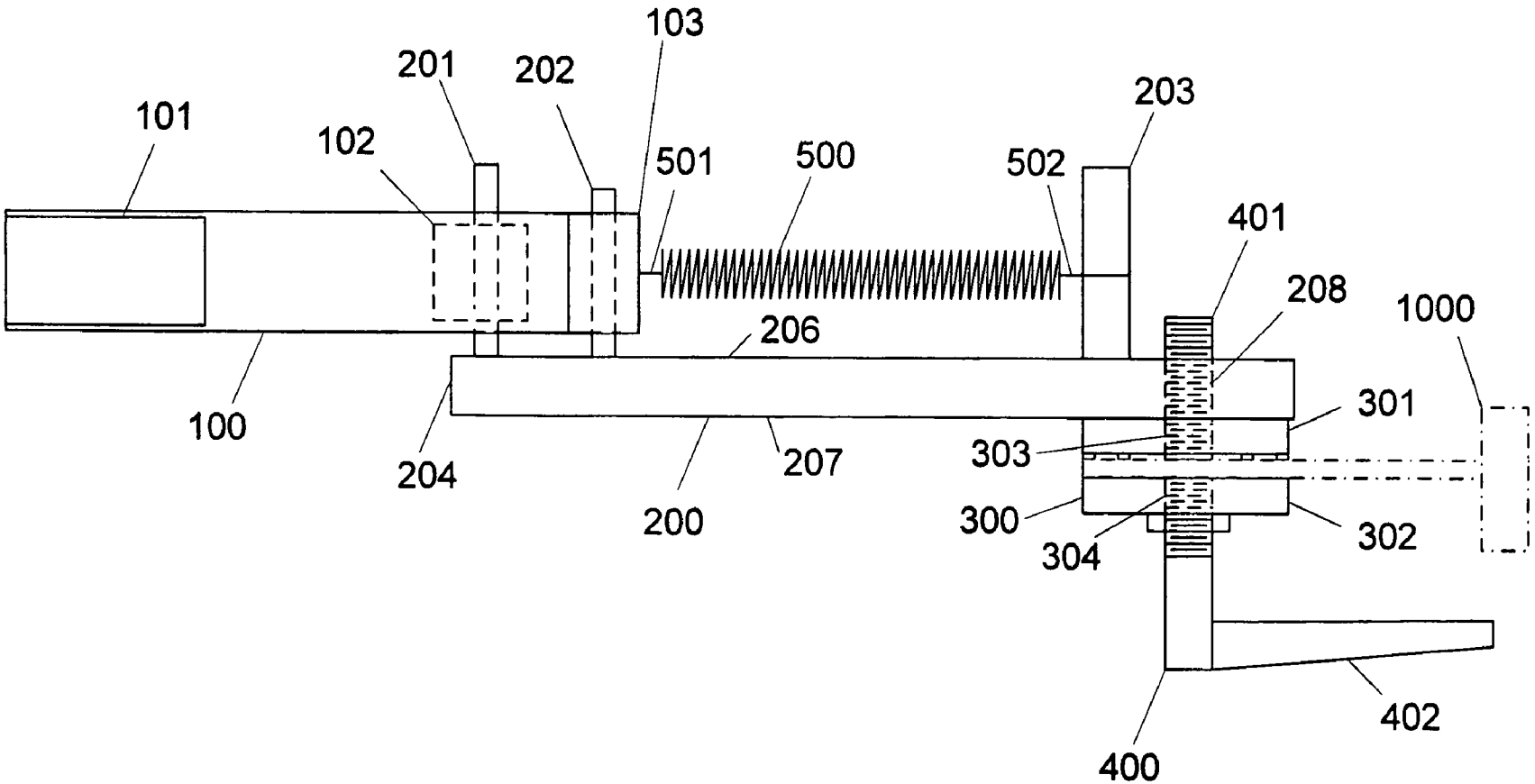
FIG. 1 is an elevation view of the preferred embodiment of the stitcher paddle.
Figure 2:
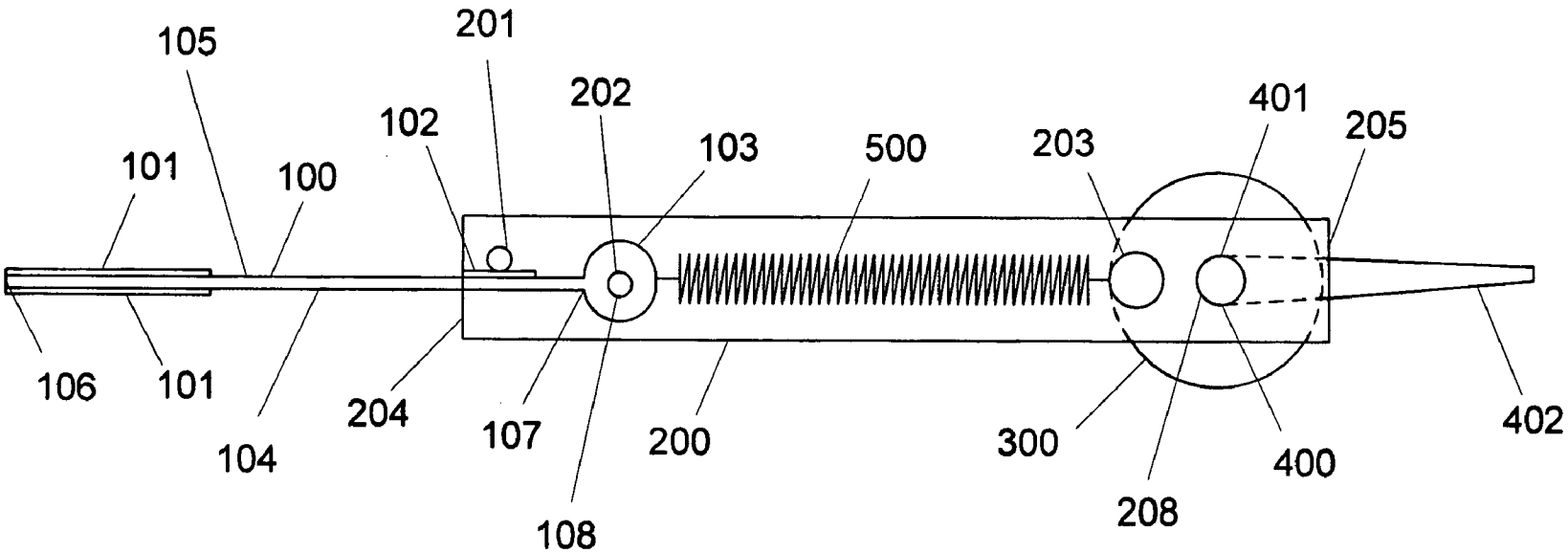
FIG. 2 is a plan view of the preferred embodiment of the stitcher paddle.

The preferred embodiment of the present invention is illustrated in FIGS. 1 and 2. As indicated therein, it consists of a paddle 100, a base 200, a clamp 300, a tightening screw 400, a spring 500 and a saddle stitcher 1000. The saddle stitcher 1000 is considered prior art and no further discussion is provided herein.

The paddle 100 has a front side 104 and a back side 105. It has a cantilevered end 106 and a supported end 107. It is outfitted on the cantilevered end 106 with a polytetrafluoroethylene (PTFE) pad 101 on the front and back sides, a rubber pad 102 on the back side 105, and a pivot post 103 at the supported end 107. The pivot post 103 is outfitted with a concentric hole 108.

The base 200 has a front end 204 and a back end 205. It has a top 206 and a bottom 207. It has a stop 201 which is attached substantially at the front end 204 on the top 206 of the base 200. It has a pivot pin 202 attached to the top 206 in a position closer to the back end 205 than the stop 201. The pivot pin is substantially round with a diameter substantially equal to the diameter of the pivot post concentric hole 108. The base 200 also has a spring mounting post 203 located on the top 206 near the back 205 of the base 200. The base also has a threaded hole 208 located between the spring mounting post 203 and the back 205.

The clamp 300 consists of an upper jaw 301 and a lower jaw 302. The upper jaw has a substantially concentric hole 303 and the lower jaw has a substantially concentric hole 304. The concentric holes are slightly larger than the threaded hole 208 in the base 200.

The tightening screw 400 consists of a threaded stud 401 and a handle 402. The threaded stud 401 is sized to engage with the threads on the threaded hole 208 in the base 200.

The spring 500 consists of a front end 501 and a back end 502. The front end 501 is attached to the pivot post 103 of the paddle 100, and the back end 502 is attached to the spring mounting post 203.

Figure 3:
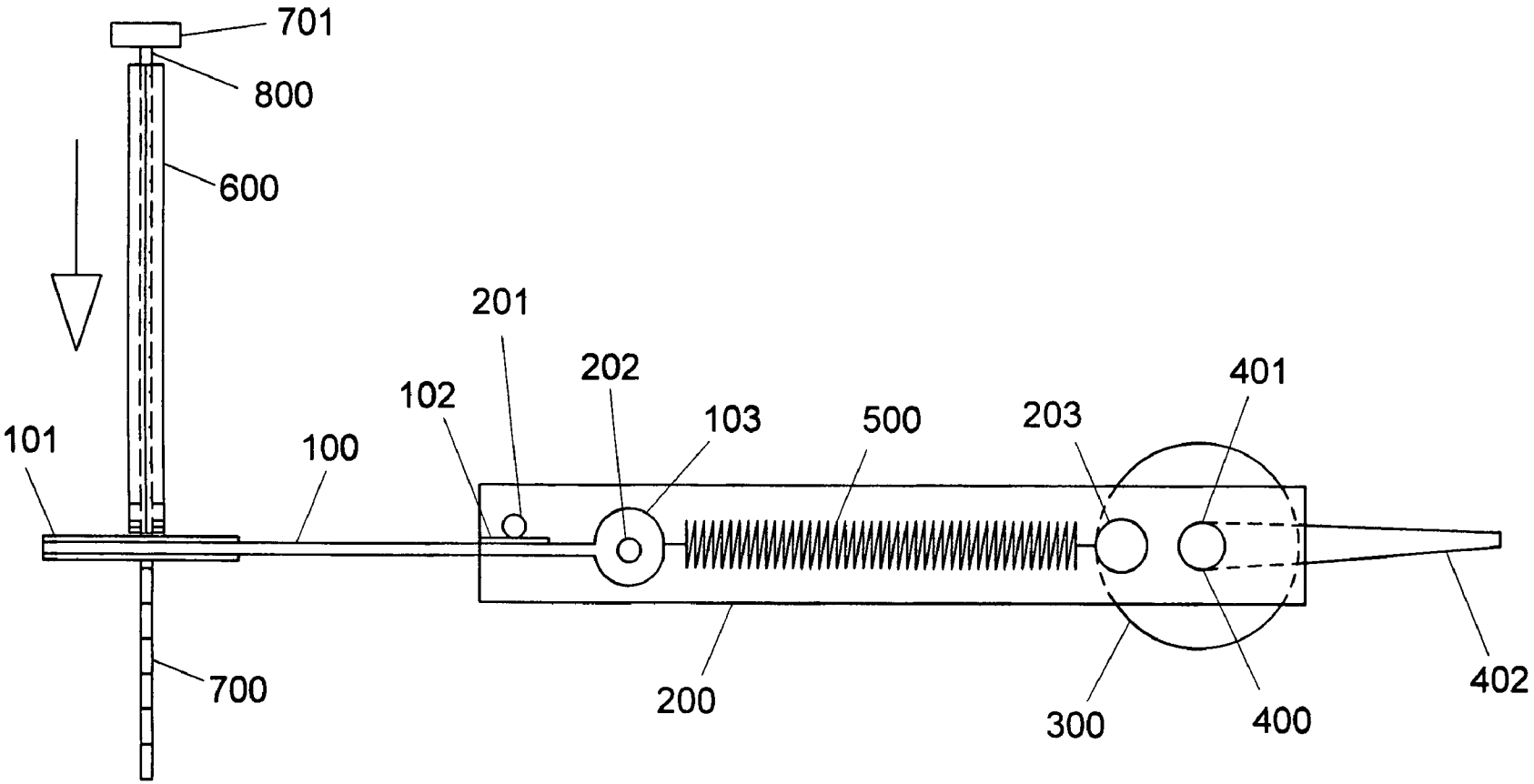
FIG. 3 is a plan view of the first step in a sequence illustrating the operation of the preferred embodiment.

A sequence illustrating the operation of the preferred embodiment of the present invention is illustrated in FIGS. 3 through 7. As indicated in FIG. 3, a signature group 600 is carried by a conveyor chain 700 toward the paddle 100. The chain 700 is outfitted with a stop 701. As illustrated in FIG. 3, there typically exists a small gap 800 between the stop 701 and signature group 600. The paddle 100 is oriented substantially perpendicular to and slightly above the conveyor chain 700.

Figure 4:
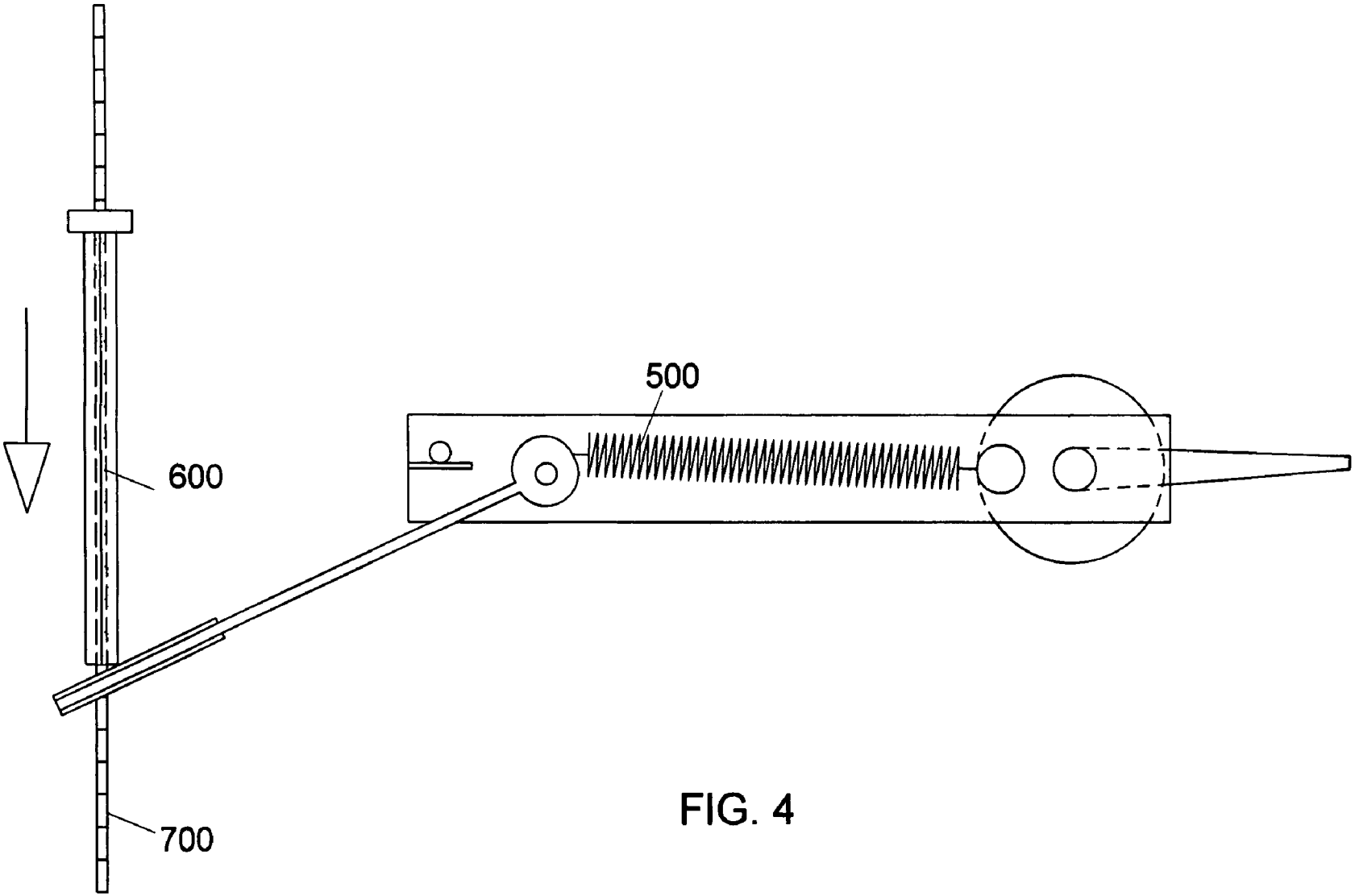
FIG. 4 is a plan view of the second step in a sequence illustrating the operation of the preferred embodiment.
Figure 5:
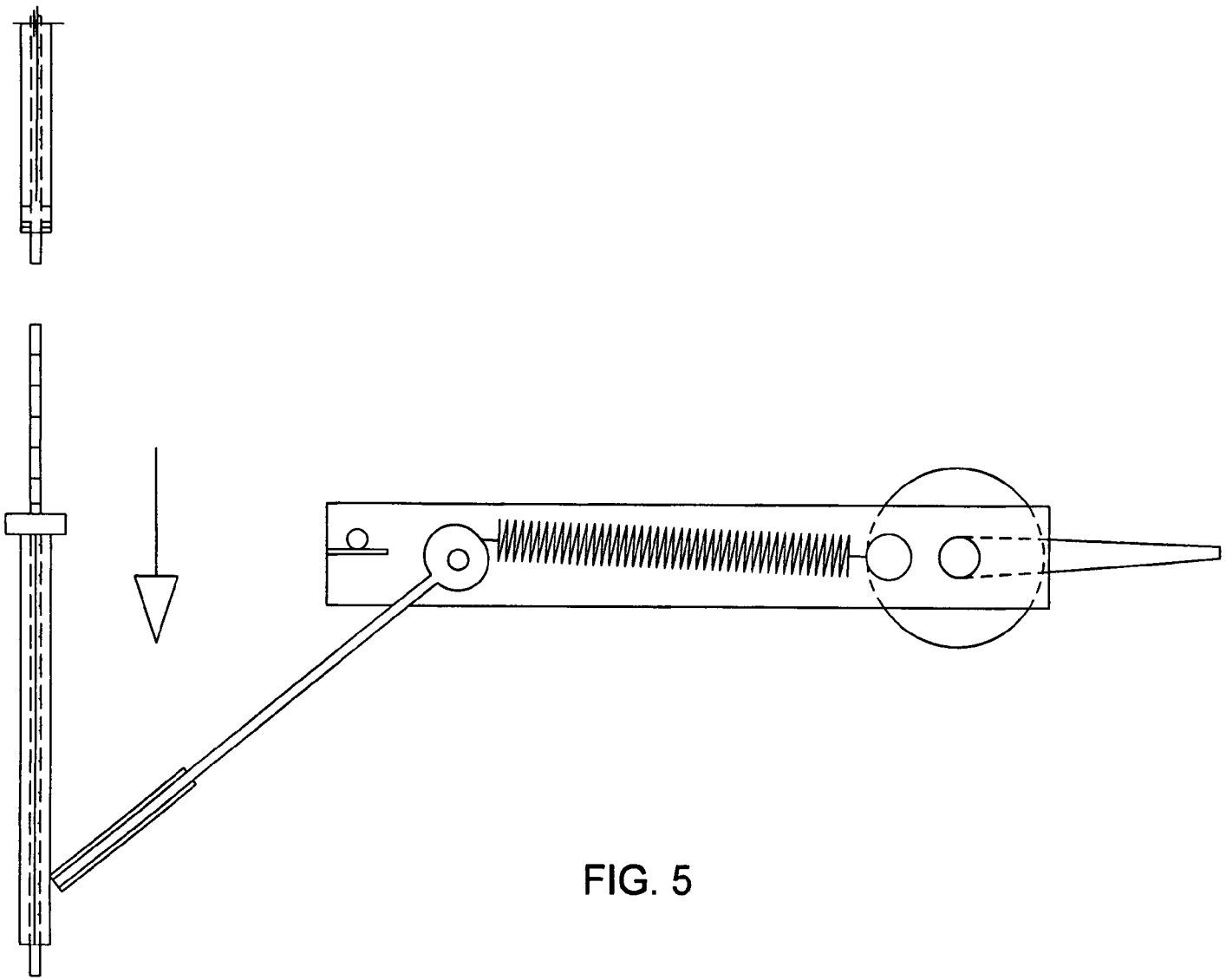
FIG. 5 is a plan view of the third step in a sequence illustrating the operation of the preferred embodiment.
Figure 6:
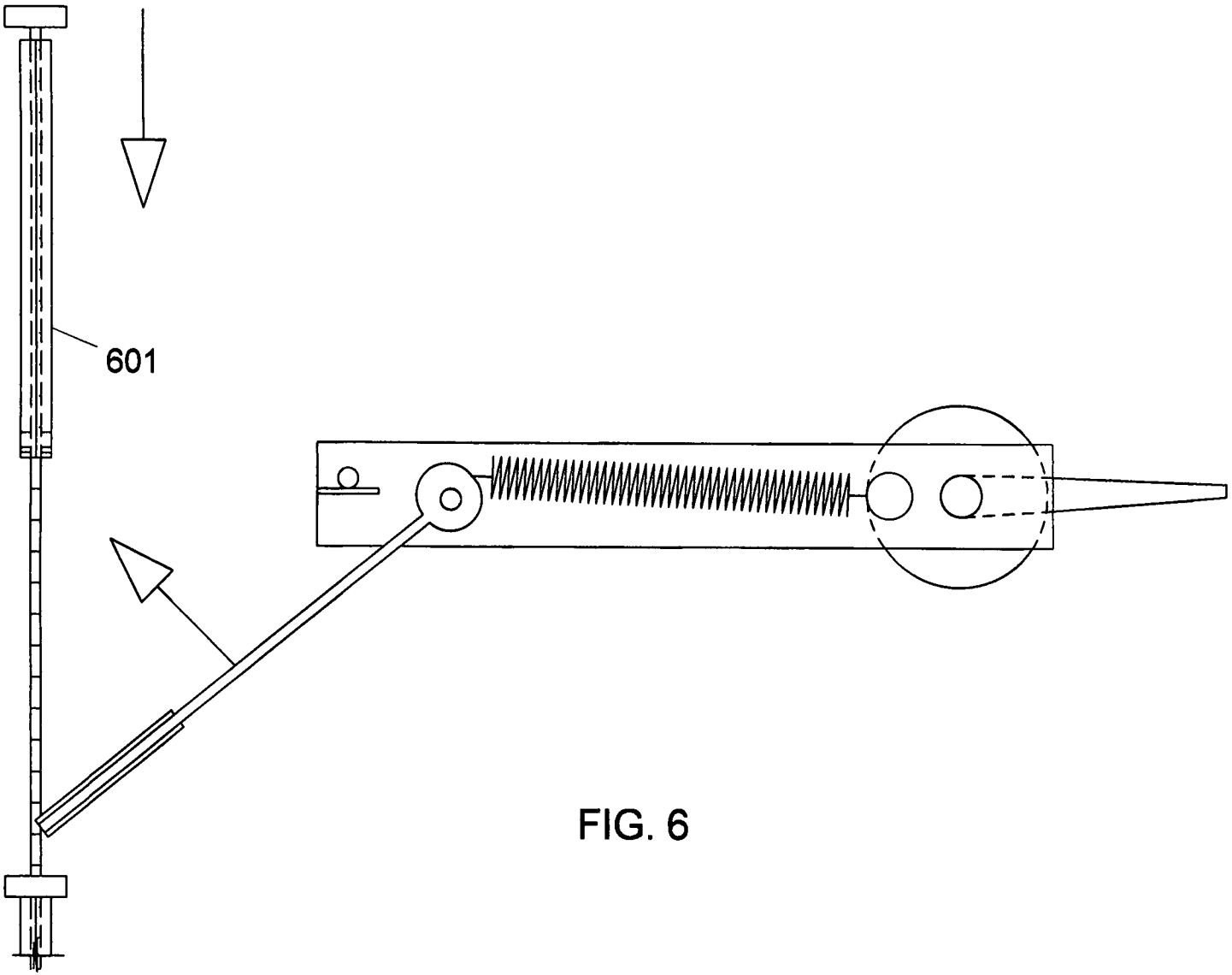
FIG. 6 is a plan view of the fourth step in a sequence illustrating the operation of the preferred embodiment.
Figure 7:
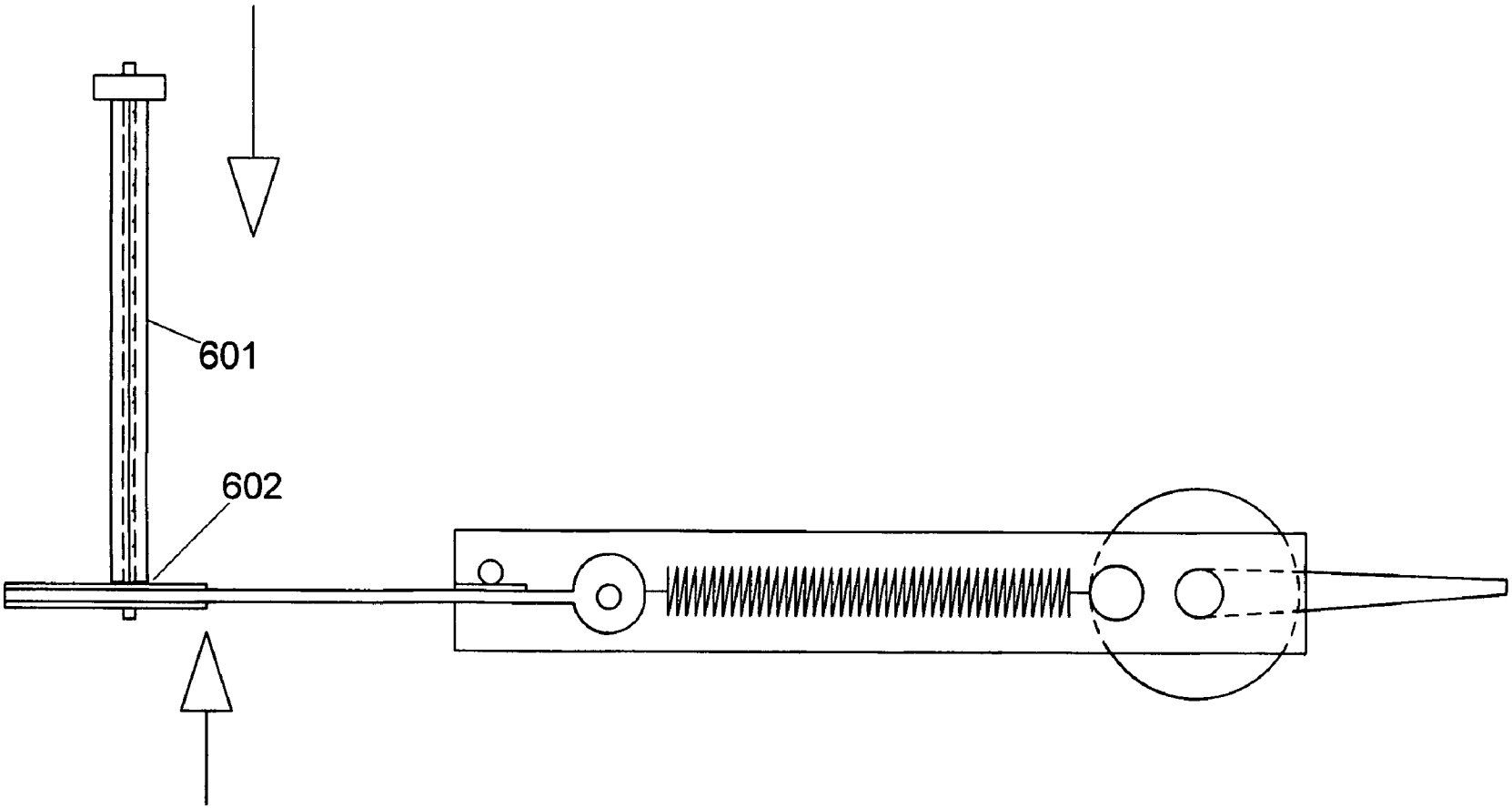
FIG. 7 is a plan view of the fifth step in a sequence illustrating the operation of the preferred embodiment.

Referring to FIGS. 4 and 5, as the conveyor chain 700 carries the signature group past the paddle 100, the paddle 100 is rotated counterclockwise as required to allow the group to pass. This counterclockwise motion stretches and preloads the spring 500. Referring to FIG. 6, after passage of the first signature group, the pre-loaded spring rotates the paddle 100 clockwise to return it to its original position. Note also in FIG. 6, the misalignment 601 of the incoming signature group. Referring to FIG. 7, as this clockwise motion continues, it eventually comes in contact with and jogs the following signature group 600, pushing all signatures against the stop 701 and into alignment 602. As the second signature group continues to be conveyed past the paddle, it rotates the paddle in a counterclockwise movement, and the process is repeated for subsequent signature groups.

Figure 8:
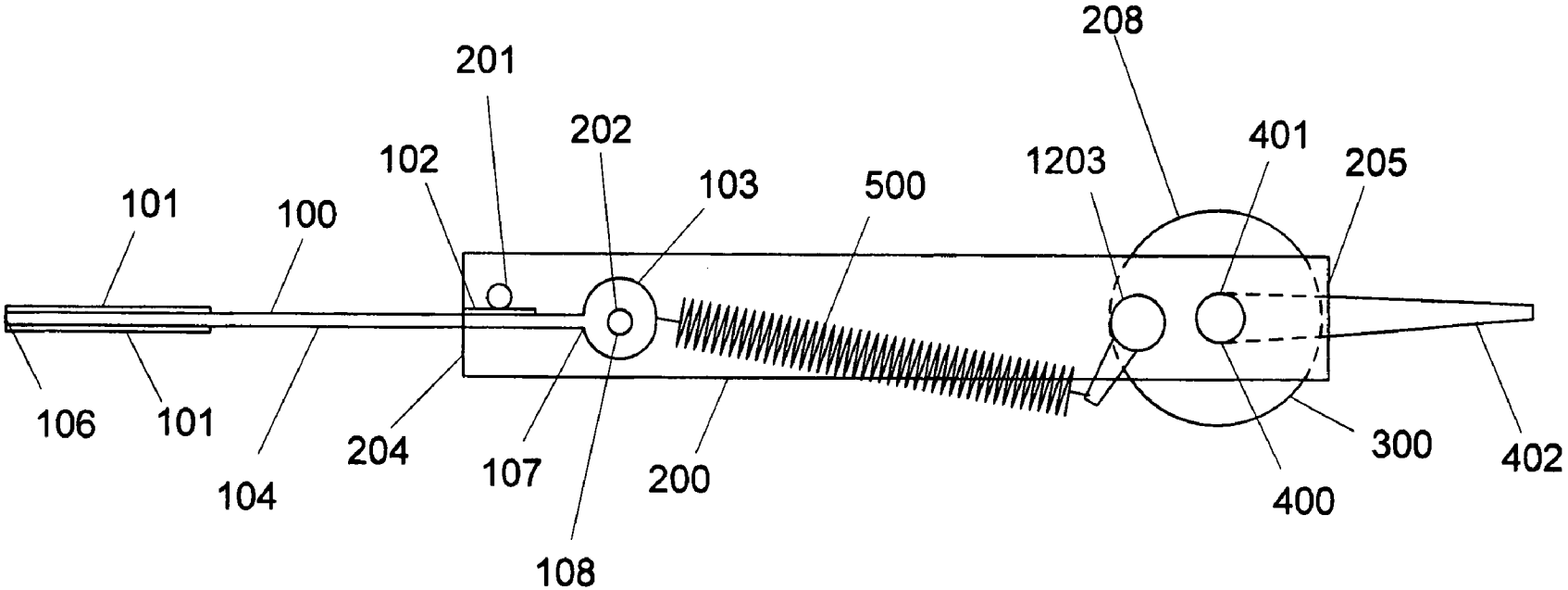
FIG. 8 is a plan view of a first alternate embodiment of the present invention.

A number of alternate embodiments of the present invention are possible. A first alternate embodiment is illustrated in FIG. 8. As indicated therein, an eccentric spring mounting post 1203 is incorporated into the design.

Figure 9:
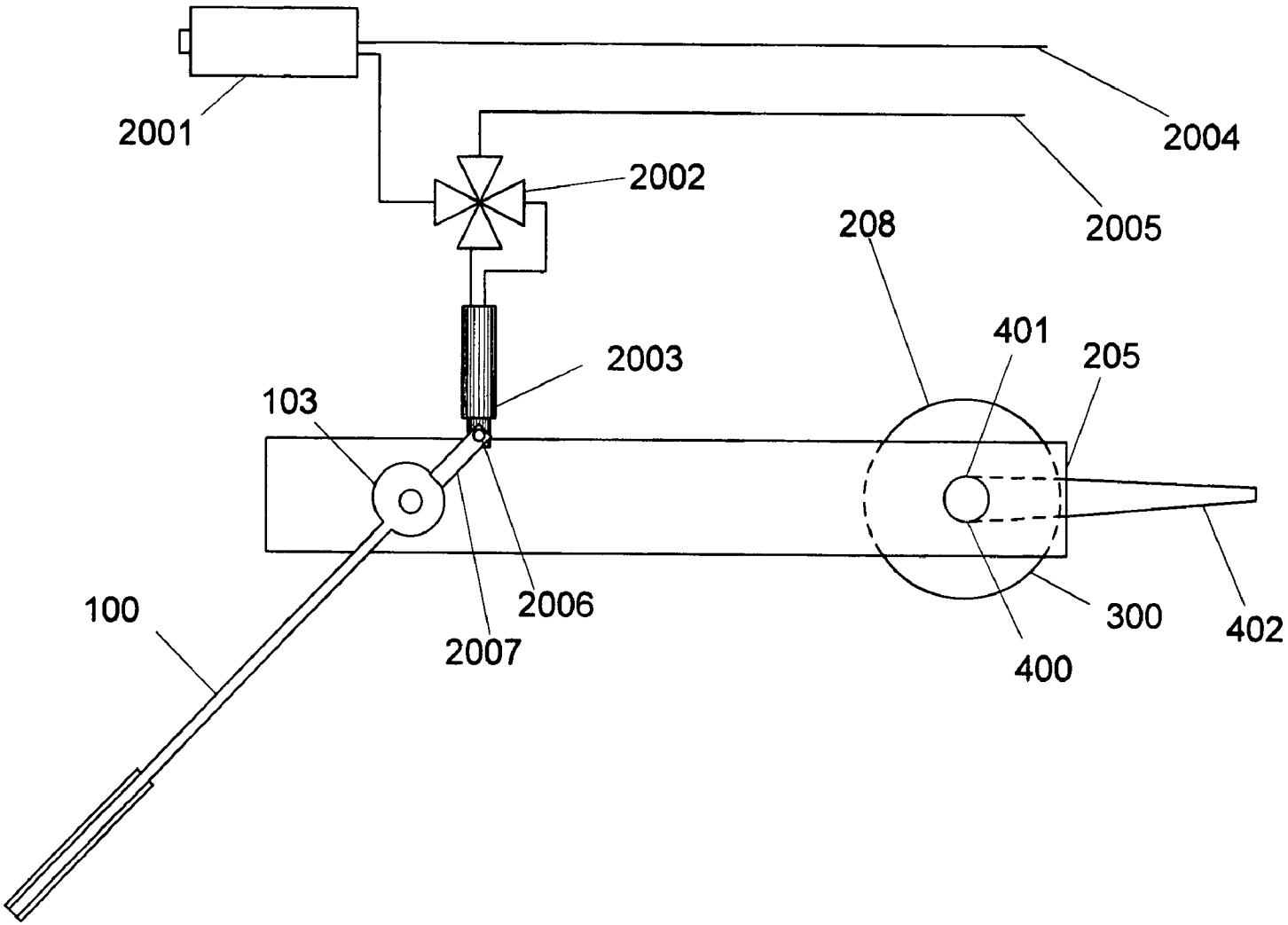
FIG. 9 is a plan view of a second alternate embodiment of the present invention.

A second alternate embodiment is illustrated in FIG. 9. As indicated, the spring is replaced by an assembly consisting of a sensor 2001, three position solenoid valve 2002, double-acting air actuated piston 2003, power supply 2004, and compressed air supply 2005. The piston 2003 is connected to the paddle assembly by piston pin 2006 which is engaged to a torque arm 2007 connected to the pivot post 103.

Figure 10:
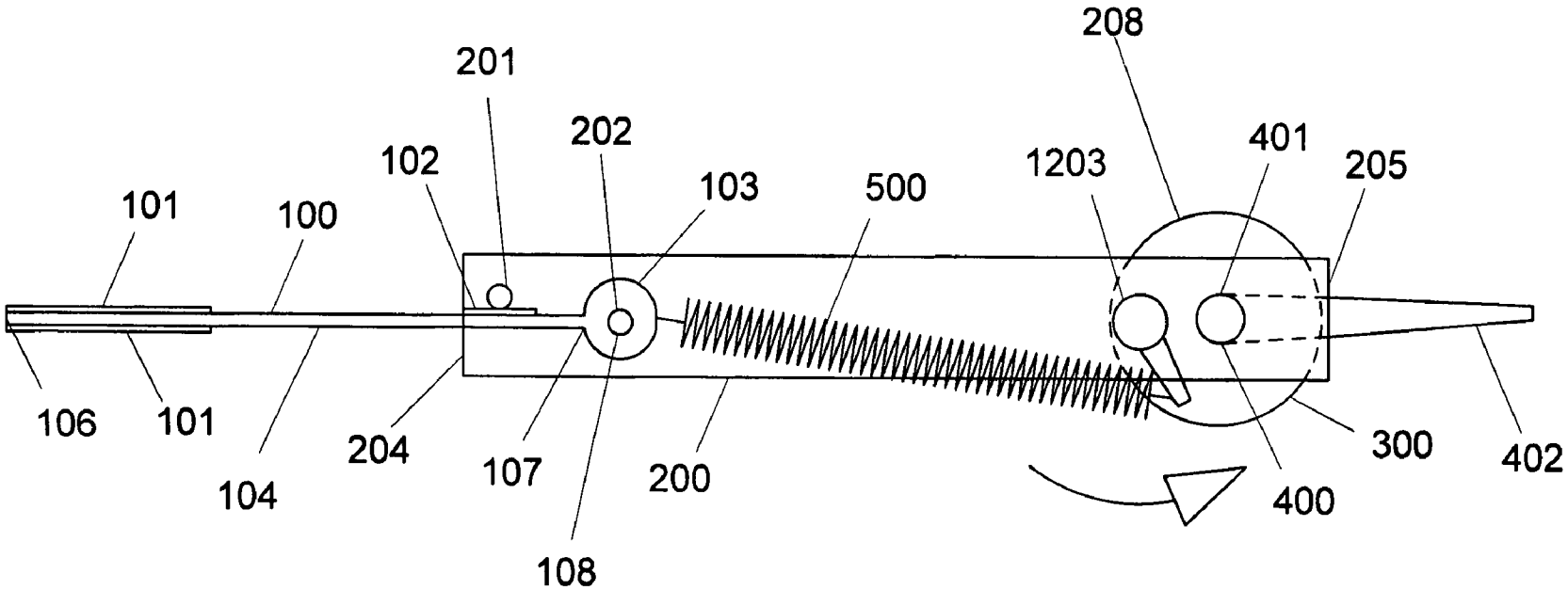
FIG. 10 is a plan view illustrating operation of the first alternate embodiment of the present invention.

The operation of the first alternate embodiment is illustrated in FIG. 10. As indicated therein, an eccentric spring mounting post 1203 is rotated as desired to develop an optimum spring tension.

Figure 11:
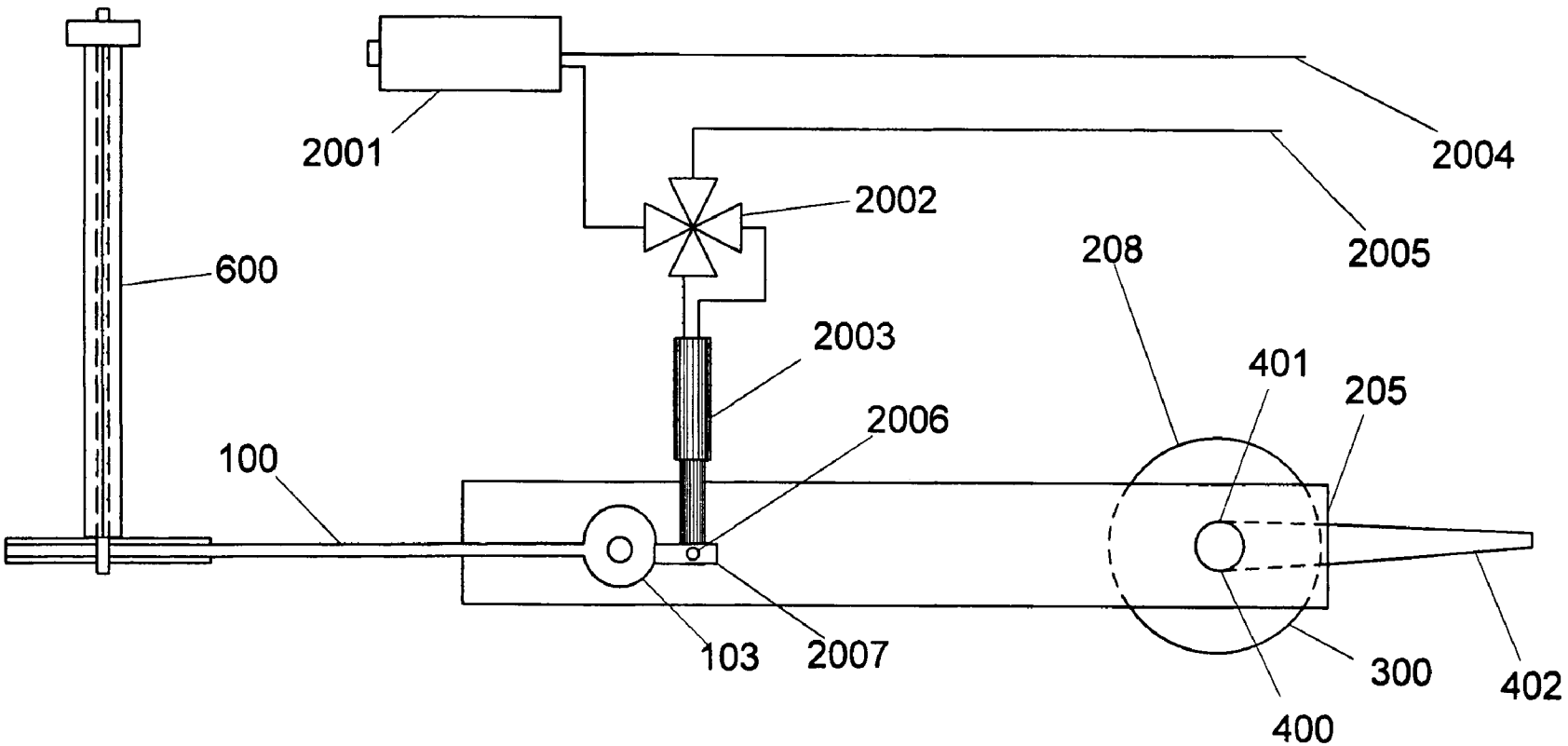
FIG. 11 is a plan view illustrating operation of the second alternate embodiment of the present invention.

The operation of the second alternate embodiment is illustrated in FIG. 11. As indicated therein, a sensor 2001 connected to power supply 2004 detects the position of the signature group 600. As the signature group reaches the optimum position, a signal is sent to a three way solenoid valve 2002 which directs compressed air 2005 to a double acting piston 2003 which exerts force on torque arm 2007 through pin 2006.

The alternate embodiments described above may be implemented singly or in any combination to suit the specific needs of the end user, and although the descriptions above contain many specifics, these should not be construed as limiting the scope of the invention, but merely providing illustrations of some of the presently preferred embodiments. Thus, the scope of the invention should be determined by the appended claims and their legal equivalents, rather than by the examples given.

What is claimed is:

1. An improved saddle stitcher assembly incorporating alignment paddle consisting of:

(a) a paddle which includes:

(i) a back end with means to engage a pivot point, (ii) said back end with means to engage a torque producing element, (b) said torque producing element includes:

(i) a means to engage the back end of the paddle, (c) a base which includes:

(i) means to support said pivot point, (ii) means to support said torque producing element, (iii) means of attachment to saddle stitcher.

2. The saddle stitcher with alignment means of claim 1 where the torque producing element consists of a helical spring.

3. The saddle stitcher with alignment means of claim 1 where said means to support said torque producing element consists of a torque arm and power-actuated piston.

4. Saddle stitcher with alignment means of claim 1 where said alignment paddle is oriented so that it comes in contact with and jogs the signature group substantially at the spine of the group.

* * * * *